US009099275B2

(12) United States Patent
Date

(10) Patent No.: US 9,099,275 B2
(45) Date of Patent: Aug. 4, 2015

(54) ION GENERATION DEVICE AND ELECTRICAL APPARATUS

(71) Applicant: SHARP KABUSHIKI KAISHA, Osaka-shi, Osaka (JP)

(72) Inventor: Kazuharu Date, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/351,594

(22) PCT Filed: Oct. 17, 2012

(86) PCT No.: PCT/JP2012/076755

§ 371 (c)(1),
(2) Date: Apr. 14, 2014

(87) PCT Pub. No.: WO2013/065479

PCT Pub. Date: May 10, 2013

(65) Prior Publication Data

US 2014/0239837 A1 Aug. 28, 2014

(30) Foreign Application Priority Data

Nov. 2, 2011 (JP) ..... 2011-241583

(51) Int. Cl.
*H01T 23/00* (2006.01)
*H01T 19/04* (2006.01)
*H01J 27/26* (2006.01)

(52) U.S. Cl.
CPC ..... *H01J 27/26* (2013.01); *H01T 19/04* (2013.01); *H01T 23/00* (2013.01)

(58) Field of Classification Search
USPC ..... 315/219; 361/230; 327/530, 543
See application file for complete search history.

(56) References Cited

U.S. PATENT DOCUMENTS

| | | | | |
|---|---|---|---|---|
| 2004/0130271 | A1 | 7/2004 | Sekoguchi et al. | |
| 2008/0158768 | A1* | 7/2008 | Yamashita et al. | 361/230 |
| 2011/0102963 | A1 | 5/2011 | Sekoguchi | |
| 2013/0083445 | A1* | 4/2013 | Okahashi | 361/230 |

FOREIGN PATENT DOCUMENTS

| | | | |
|---|---|---|---|
| JP | 3460021 | B2 | 10/2003 |
| JP | 2008-171785 | A | 7/2008 |
| JP | 4489090 | B2 | 6/2010 |
| JP | 4503085 | B2 | 7/2010 |

* cited by examiner

*Primary Examiner* — Daniel D Chang
(74) *Attorney, Agent, or Firm* — Birch, Stewart, Kolasch & Birch, LLP

(57) ABSTRACT

An ion generation device includes: a high voltage generation circuit; and an ion generation element. The high voltage generation circuit includes: a capacitor; a high voltage transformer; a switching element; and a pulse signal generation portion which generates a pulse signal for controlling the turning on and off of the switching element. The pulse signal generation portion adjusts a pulse width of an on-period such that the pulse width of the on-period of the pulse signal is substantially equal to a time obtained by multiplying the reciprocal of an output voltage frequency at the time of a forward operation of the high voltage transformer by one-fourth.

11 Claims, 9 Drawing Sheets

(a)

(b)

(a)

(b)

(a)

(b)

ION GENERATION DEVICE AND ELECTRICAL APPARATUS

TECHNICAL FIELD

The present invention relates to an ion generation device that can improve an indoor environment by discharging ions into a space, and an electrical apparatus that includes such an ion generation device. Examples of the electrical apparatus described above include an air conditioner, a dehumidifier, a humidifier, an air cleaner, a refrigerator, a fan heater, a microwave oven, a washer-dryer, a vacuum cleaner and a sterilizer that are mainly used in a closed space (such as within a house, in a room within a building, in a hospital room or an operating room of a hospital, within an automobile, within an airplane, within a ship, within a warehouse or within a refrigerator).

BACKGROUND ART

Various types of ion generation devices utilizing a discharge phenomenon are commercially available. These ion generation devices are generally formed with: an ion generation element for generating ions; a high voltage transformer for supplying a high voltage to the ion generation element; a high voltage generation circuit for driving the high voltage transformer; and a power supply input portion such as a connector.

As examples of the commercially available ion generation element, there can be an ion generation element in which a metal wire, a metal plate having an acute-angled portion, a needle-shaped metal or the like is used as a discharge electrode and in which a metal plate, a grid or the like of ground potential is used as an induction electrode (opposite electrode) and an ion generation element in which a metal wire, a metal plate having an acute-angled portion, a needle-shaped metal or the like is used as a discharge electrode and in which ground is used instead of an induction electrode and no induction electrode is particularly arranged. In these ion generation elements, air functions as an insulator. In these ion generation elements, when a high voltage is applied between the discharge electrode and the induction electrode or the ground, electric field concentration occurs at the acute-angled top end of the discharge electrode, air close to the top end is subjected to breakdown and thus a discharge phenomenon is obtained, with the result that ions are generated.

An example of the ion generation device having the ion generation element that generates ions in the above method is disclosed in patent document 1. The ion generation device disclosed in patent document 1 is a device that includes a discharge electrode having a needle-shaped metal and a perforated flat-plate electrode provided opposite the discharge electrode, and that takes, out of the device, positive ions and negative ions generated together with corona discharge.

Another example of the ion generation device having the ion generation element that generates ions in the above method is disclosed in patent document 2. The ion generation device disclosed in patent document 2 is a device that includes a high voltage generation circuit utilizing an alternating-current waveform in a commercial power supply.

Yet another example of the ion generation device having the ion generation element that generates ions in the above method is disclosed in patent document 3. The ion generation device disclosed in patent document 3 is a device that uses, in a high voltage generation circuit, a switching element which drives a step-up transformer and a control circuit which outputs a pulse signal for controlling the turning on and off of the switching element, and that can use, as the control circuit, a microcontroller (microcomputer).

An example of a corona discharge device that generates ozone with corona discharge is disclosed in patent document 4. The corona discharge generation device disclosed in patent document 4 is a device in which in order to generate a pulse train for generating a high voltage, with a central processing unit (CPU), pulse train modulation such as pulse width modulation (PWM) or pulse position modulation (PPM) is used.

RELATED ART DOCUMENT

Patent Document

Patent document 1: Japanese Patent No. 4503085
Patent document 2: Japanese Patent No. 3460021
Patent document 3: Japanese Patent No. 4489090
Patent document 4: JP-A-2008-171785

DISCLOSURE OF THE INVENTION

Problems to be Solved by the Invention

All the devices disclosed in patent documents 1 to 4 described above include the high voltage generation circuit using the high voltage transformer. That a pulse current is passed through the primary winding that is the input side of the high voltage transformer to generate a high voltage on the secondary winding that is the output side of the high voltage transformer is a known technology which is also disclosed in a large number of known documents other than patent documents 1 to 4.

FIG. 5 of patent document 3 discloses that the pulse width (time) of the current passed through the primary winding of the step-up transformer is changed, and thus it is possible to change the secondary output voltage of the step-up transformer. FIG. 5 of patent document 4 discloses that the pulse width of the current passed through the primary winding of the transformer is changed, and thus it is possible to change the width of an output voltage waveform according to the pulse width.

However, in actuality, the frequency of a voltage output from the secondary winding of the transformer is substantially determined by the frequency characteristic of the transformer or the like; even if the pulse width of the current passed through the primary winding of the transformer is changed, it is impossible to freely change the secondary output voltage of the transformer or to change the width of the output voltage waveform.

In all patent documents 1 to 3 described above, only a method of generating a high voltage pulse is disclosed but a method of efficiently generating a high voltage with a low consumption current is not disclosed. This is probably because a conventional electrical apparatus incorporating the ion generation device is a somewhat large apparatus such as an air cleaner, an air conditioner or a static eliminator, and power is supplied from a commercial power supply line (such as a household outlet). However, in the future, when the size of the ion generation device is further reduced to achieve battery drive, it will be important to reduce consumption current.

In the currently commercially available ion generation devices, since the power consumption of an ion generation circuit block including a high voltage generation circuit reaches 0.5 watt to a few watts, and thus the power consumption is large, it is difficult to incorporate it in a battery-operated portable apparatus or the like.

Even in patent document 4 described above, only a method of generating a high voltage pulse is disclosed but a method of efficiently generating a high voltage with a low consumption current is not disclosed. This is probably because in the 10th paragraph of patent document 4, only the incorporation into a portable apparatus is disclosed, but only reduction in size and weight is a technical problem to be solved.

In view of the foregoing conditions, an object of the present invention is to provide an ion generation device that reduces power consumption and an electrical apparatus that incorporates such an ion generation device.

Means for Solving the Problem

To achieve the above object, according to the present invention, there is provided an ion generation device including: a high voltage generation circuit; and an ion generation element to which a high voltage output from the high voltage generation circuit or a voltage generated based on the high voltage output from the high voltage generation circuit is applied, where the high voltage generation circuit includes: a capacitor which stores an input direct-current voltage or a voltage obtained by performing DC/DC conversion on the input direct-current voltage; a high voltage transformer which steps up a voltage output from the capacitor connected to a primary side to output a high voltage to a secondary side; a switching element which is connected to the primary side of the high voltage transformer and which intermittently passes a current on the primary side of the high voltage transformer by being turned on and off; and a pulse signal generation portion which generates a pulse signal for controlling the turning on and off of the switching element, and the pulse signal generation portion adjusts a pulse width of an on-period such that the pulse width of the on-period during which the switching element is kept on by the pulse signal is substantially equal to a time obtained by multiplying a reciprocal of an output voltage frequency at a time of a forward operation of the high voltage transformer by one-fourth (first configuration).

In this configuration, since the pulse width of the on-period during which the switching element is kept on by the pulse signal is made substantially equal to the time obtained by multiplying the reciprocal of the output voltage frequency at the time of the forward operation of the high voltage transformer by one-fourth, and thus it is possible to continuously utilize the forward operation and the fly-back operation of the high voltage transformer, it is possible to reduce the power consumption.

Preferably, in the ion generation device of the first configuration, the pulse width of the on-period adjusted by the pulse signal generation portion can be changed (second configuration).

In this configuration, it is possible to reduce the power consumption by corresponding to high voltage transformers of various specifications.

Preferably, in the ion generation device of the first or second configuration, the switching element is directly driven by the pulse signal (third configuration).

In this configuration, since it is not necessary to provide a buffer circuit between the pulse generation portion and the switching element, the cost and the size are advantageously reduced.

Preferably, in the ion generation device of any one of the first to third configurations, the capacitor stores the input direct-current voltage (fourth configuration).

In this configuration, since it is not necessary to provide a DC/DC converter that performs DC/DC conversion on the input direct-current voltage, the cost and the size are advantageously reduced.

Preferably, in the ion generation device of any one of the first to fourth configurations, the capacitor is a ceramic capacitor or a film capacitor (fifth configuration).

In this configuration, since the ESR (equivalent series resistance) of the capacitor is low, it is suitable for a case where a high current is passed to the primary side of the high voltage transformer for a short period of time.

Examples of the switching element can include a MOS-FET (metal oxide semiconductor-field effect transistor), a bipolar transistor and an IGBT (insulated gate bipolar transistor).

The pulse signal generation portion may be either a microcontroller which controls the generation of the pulse signal with software or a dedicated circuit which controls the generation of the pulse signal with hardware.

An electrical apparatus according to the present invention includes: the ion generation device of any one of the configurations described above; and a feed-out portion for feeding ions generated by the ion generation device out of the ion generation device.

Advantages of the Invention

In the present invention, since the pulse width of the on-period during which the switching element is kept on by the pulse signal is made substantially equal to the time obtained by multiplying the reciprocal of the output voltage frequency at the time of the forward operation of the high voltage transformer by one-fourth, and thus it is possible to continuously utilize the forward operation and the fly-back operation of the high voltage transformer, it is possible to realize an ion generation device that reduces power consumption and an electrical apparatus that incorporates such an ion generation device.

DESCRIPTION OF EMBODIMENTS

An embodiment of the present invention will be described below with reference to accompanying drawings.

Figure 1:
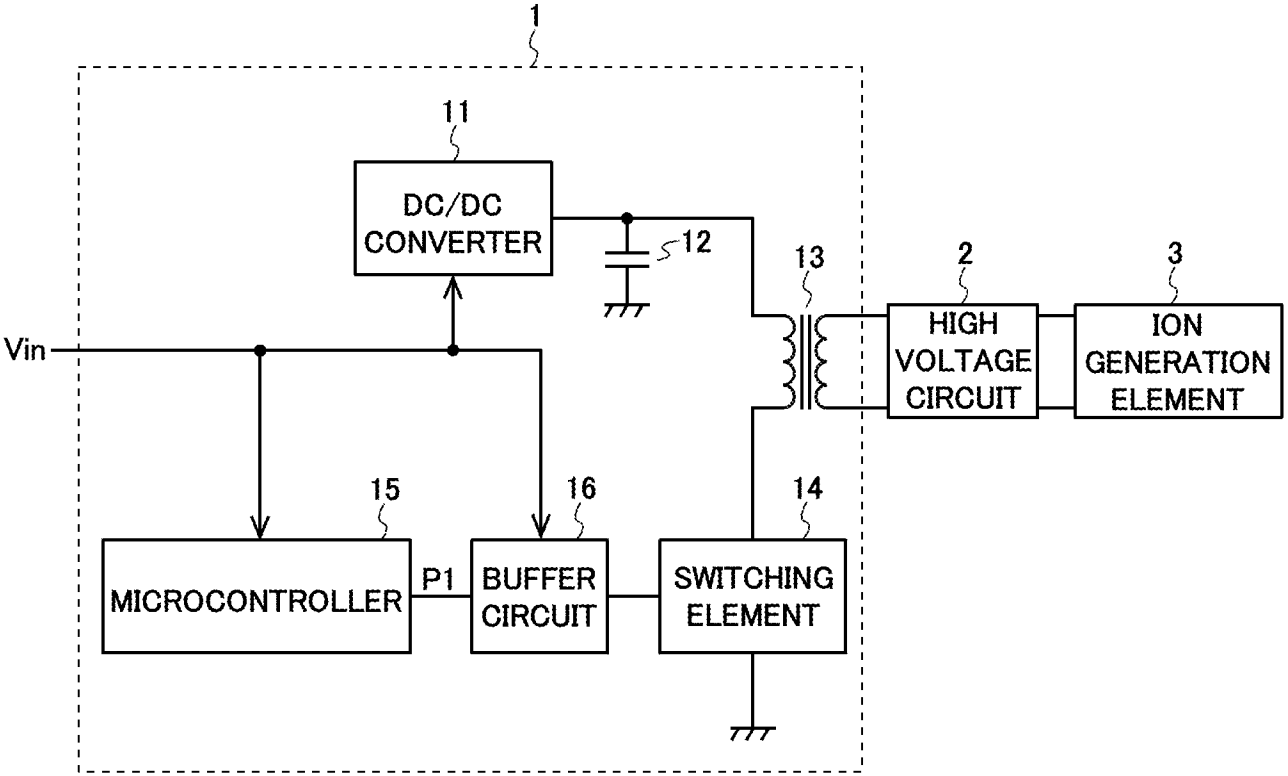
FIG. 1 A diagram showing a schematic configuration of an ion generation device according to an embodiment of the present invention.

A schematic configuration of an ion generation device according to the embodiment of the present invention will be shown in FIG. 1. The ion generation device shown in FIG. 1 and according to the embodiment of the present invention includes a high voltage generation circuit 1, a high voltage circuit 2 that generates a high voltage applied to an ion generation element 3 based on a high voltage output from the high voltage generation circuit 1 and the ion generation element 3.

The high voltage generation circuit 1 includes: a DC/DC converter 11 that performs DC/DC conversion on an input direct-current voltage Vin; a capacitor 12 that stores a voltage output from the DC/DC converter 11; a high voltage transformer 13 that steps up a voltage output from the capacitor 12, which is connected to the primary side, and that outputs a high voltage to the secondary side; a switching element 14 that is connected to the primary side of the high voltage transformer 13 and that intermittently passes a current on the primary side of the high voltage transformer 13 by being turned on and off; a microcontroller 15 that generates a pulse signal P1 for controlling the turning on and off of the switching element 14; and a buffer circuit 16 that adjusts the pulse signal P1 output from the microcontroller 15 provided between the switching element 14 and the microcontroller 15 according to the rated specification of the voltage and current of the switching element 14. Each of the microcontroller 15 and the buffer circuit 16 is operated using the input direct-current voltage Vin as a drive voltage.

In the present embodiment, the input direct-current voltage Vin is set at about 10 V. Since when the input direct-current voltage Vin is excessively high, the size of components used in the DC/DC converter 11 is increased, the input direct-current voltage Yin is preferably about a few tens of volts in terms of efficiency and size.

Depending on the characteristics and the rated specification of the components used, the DC/DC converter 11 and the buffer circuit 16 may be omitted. When the DC/DC converter 11 is omitted, the capacitor 12 stores the input direct-current voltage Vin. When the buffer circuit 16 is omitted, the switching element 14 is directly driven by the pulse signal P1 output from the microcontroller 15.

When a high voltage transformer is operated by pulse drive, a current ranging from a few amperes to a few tens of amperes is often passed instantaneously to the primary side of the high voltage transformer according to the characteristics of the high voltage transformer. In the present embodiment, a current ranging from about 15 A to about 20 A is passed for a few microseconds. Since it is impossible to pass, for a short period of time, such a high current directly from the DC/DC converter 11, a battery that is assumed to be the power supply of the input direct-current voltage Vin or the like, it is necessary to temporarily store the current in the capacitor 12 and supply it from the capacitor 12 to the high voltage transformer 13. Since as described above, it is necessary to pass, for a short period of time, a high current from the capacitor 12 to the high voltage transformer 13, it is preferable to use, as the capacitor 12, a capacitor whose ESR is low. Examples of the capacitor whose ESR is low include a ceramic capacitor and a film capacitor.

As will be described in detail later, since in the present invention, the forward operation of the high voltage transformer is utilized, it is preferable to use, as the high voltage transformer 13, a transformer having a characteristic suitable for the forward operation, that is, a characteristic of a closed magnetic path and a high binding rate.

Examples of the switching element 14 can include a MOS-FET, a bipolar transistor and an IGBT. As the switching element 14, it is preferable to use a switching element in which its frequency characteristic is satisfactory and in which its on-resistance is 100 mΩ or less. Since when the switching element 14 is changed from the on-state to the off-state, the fly-back operation of the high voltage transformer 13 produces a serge voltage, it is preferable to uses, as the switching element 14, a switching element in which the voltage resistance between a first terminal connected to the primary side of the high voltage transformer and a second terminal connected to the ground is equal to or more than the surge voltage (for example, 100 V or more).

Figure 2:
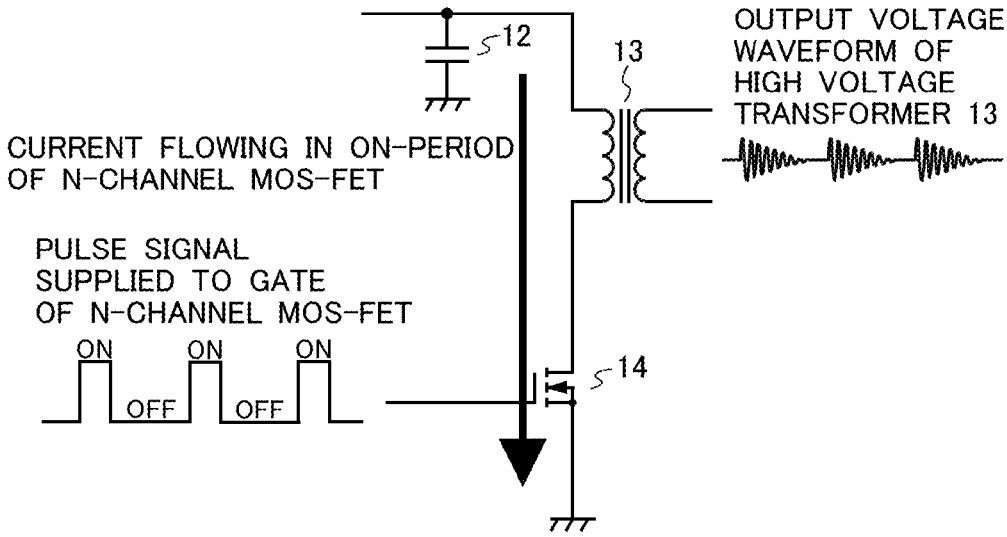
FIG. 2 A schematic diagram of the main portions of the ion generation device shown in FIG. 1 in a case where an N-channel MOS-FET is used.

For example, when an N-channel MOS-FET in which its frequency characteristic is satisfactory and its drain-source voltage resistance is high is used as the switching element 14, as shown in FIG. 2, the drain of the N-channel MOS-FET is connected to the primary winding of the high voltage transformer 13 and the source of the N-channel MOS-FET is connected to the ground. Since in an N-channel MOS-FET in which its drain-source voltage resistance is high, its gate drive voltage is often high, when it is impossible to directly drive the N-channel MOS-FET with the terminal voltage of the microcontroller 15, as in the present embodiment, it is necessary to provide the buffer circuit 16 between the microcontroller 15 and the N-channel MOS-FET used as the switching element 14 (see FIG. 1). As an example of the buffer circuit 16, there can be a two-power supply level shifter.

When the N-channel MOS-FET is used as the switching element 14, while the pulse signal supplied to the N-channel MOS-FET is high, the N-channel MOS-FET is turned on, drain-source continuity is achieved and a current is passed to the primary side of the high voltage transformer 13 whereas while the pulse signal supplied to the gate of the N-channel MOS-FET is low, the N-channel MOS-FET is turned off, drain-source interruption is achieved and a current is not passed to the primary side of the high voltage transformer 13. By turning on and off the current on the primary side of the high voltage transformer 13, a high voltage is output to the secondary side of the high voltage transformer 13.

Although in the present embodiment, as the pulse signal generation portion that generates the pulse signal P1 for controlling the turning on and off of the switching element 14, the microcontroller 15 that controls the generation of the pulse signal P1 with software is used, instead of the microcontroller 15, a dedicated circuit that controls the generation of the pulse signal P1 with hardware may be used.

Although in the present embodiment, the high voltage circuit 2 is provided between the high voltage generation circuit 1 and the ion generation element 3, without provision of the high voltage circuit 2, for example, an ion generation element having only one discharge portion may be directly connected to the secondary winding of the high voltage transformer 13.

Figure 3:
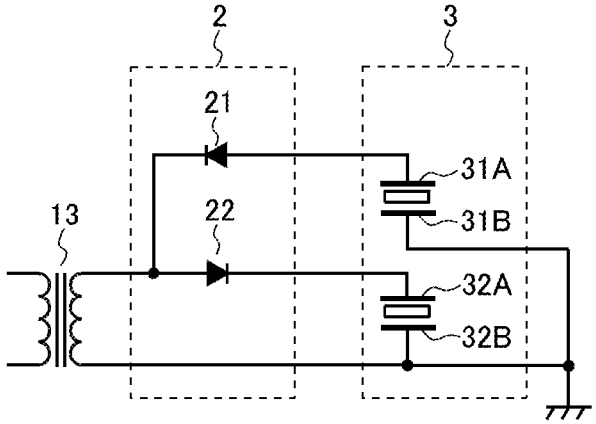
FIG. 3 A diagram showing an example of a high voltage circuit and an ion generation element.

An example of the high voltage circuit 2 and the ion generation element 3 will now be described with reference to FIG. 3. In the example shown in FIG. 3, the high voltage circuit 2 is formed with rectifier diodes 21 and 22, and the ion generation element 3 includes a first discharge electrode 31A and a first induction electrode 31B of a first discharge portion and a first second discharge electrode 32A and a second induction electrode 32B of a second discharge portion. The cathode of the rectifier diode 21 and the anode of the rectifier diode 22 are connected to the secondary winding of the high voltage transformer 13, the anode of the rectifier diode 21 is electrically connected to the first discharge electrode 31A of the first discharge portion in the ion generation element 3, and the cathode of the rectifier diode 22 is electrically connected to the second discharge electrode 32A of the second discharge portion in the ion generation element 3. The first induction electrode 31B of the first discharge portion and the second induction electrode 32B of the second discharge portion in the ion generation element 3 are connected to the ground.

Figure 4A:
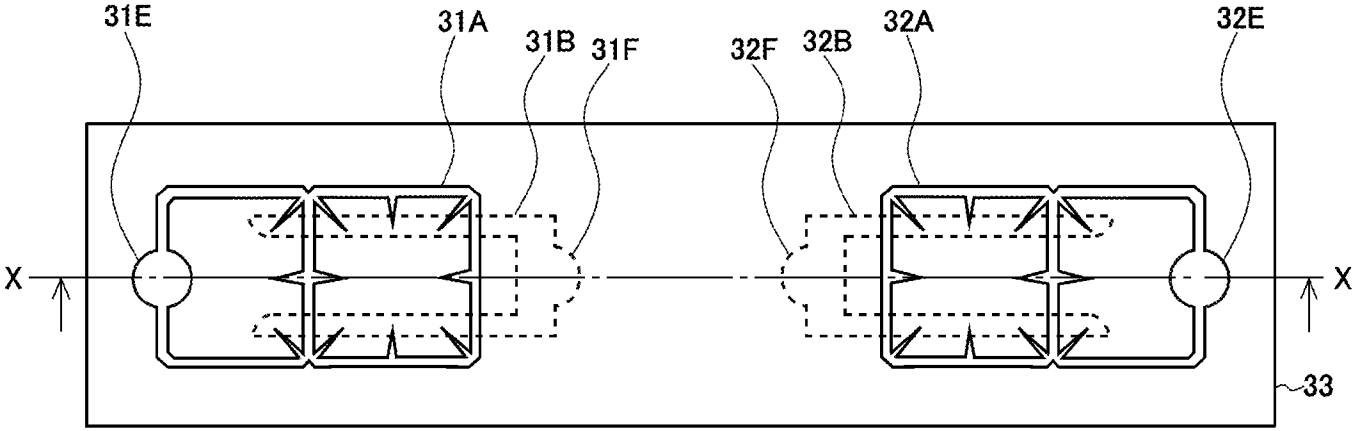
FIG. 4A A top view of the ion generation element according to a first structure example including a first discharge portion and a second discharge portion.
Figure 4B:
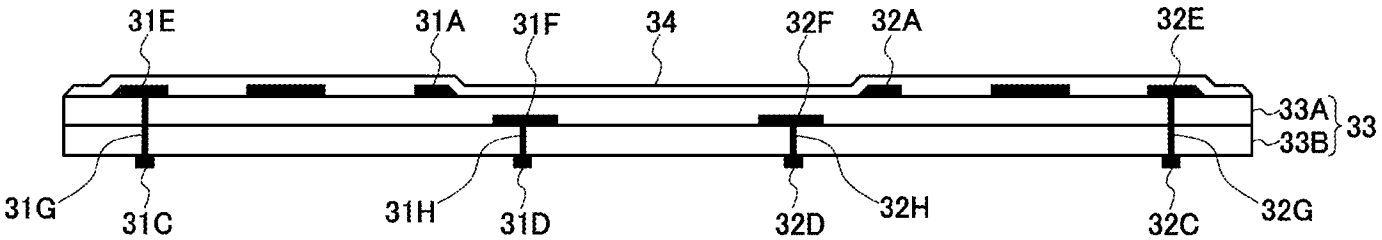
FIG. 4B A cross-sectional view of the ion generation element according to the first structure example including the first discharge portion and the second discharge portion.

Here, an ion generation element according to a first structure example including the first discharge portion and the second discharge portion will be shown in FIGS. 4A and 4B. FIG. 4A is a top view of the ion generation element according to the first structure example; FIG. 4B is a cross-sectional view taken along line X-X of the ion generation element according to the first structure example.

The ion generation element shown in FIGS. 4A and 413 and according to the first structure example includes: the first discharge portion (the first discharge electrode 31A, the first induction electrode 31B, a discharge electrode contact point 31C, an induction electrode contact point 31D, connection terminals 31E and 31F and connection paths 31G and 31H); the second discharge portion (the second discharge electrode 32A, the second induction electrode 32B, a discharge electrode contact point 32C, an induction electrode contact point 32D, connection terminals 32E and 32F and connection paths 32G and 32H); a dielectric member 33 (an upper dielectric member 33A and a lower dielectric member 33B); and a coating layer 34.

The dielectric member 33 is formed by adhering the upper dielectric member 33A and the lower dielectric member 33B, which are substantially formed in the shape of a rectangular parallelepiped. If an inorganic material is selected as the material of the dielectric member 33, a ceramic such as high purity alumina, crystallized glass, forsterite or steatite can be used. If an organic material is selected as the material of the dielectric member 33, a resin, such as polyimide or glass epoxy, that is excellent in oxidation resistance is preferable. However, with consideration given to corrosion resistance, as the material of the dielectric member 33, an inorganic material is preferably selected; furthermore, with consideration given to moldability or ease of formation of the electrode, which will be described later, it is preferable to perform the molding with ceramic. Since it is preferable that an insulation resistance between the first discharge electrode 31A and the first induction electrode 31B and an insulation resistance between the second discharge electrode 32A and the second induction electrode 32B be individually uniform, the material of the dielectric member 33 more preferably has little variation in density and a uniform insulation rate. As the shape of the dielectric member 33, a shape (such as a disc shape, an oval plate shape or a polygonal plate shape) other than an approximate rectangular parallelepiped may be adopted; furthermore, the dielectric member 33 may be formed in the shape of a cylinder but with consideration given to productivity, as in the example of the present configuration, the dielectric member 33 is preferably formed in the shape of a flat plate (including a disc or a rectangular parallelepiped).

The first discharge electrode 31A and the second discharge electrode 32A are formed integrally with the upper dielectric member 33A on the surface of the upper dielectric member 33A. As the material of the first discharge electrode 31A and the second discharge electrode 32A, a material, such as tungsten, that has conductivity can be used without any particular restriction as long as it does not undergo deformation such as melting by discharge.

The first induction electrode 31B and the second induction electrode 32B are provided parallel to the first discharge electrode 31A and the second discharge electrode 32A through the upper dielectric member 33A. Since in this arrangement, it is possible to make constant the distance between the discharge electrode and the induction electrode opposite each other (hereinafter referred to as an electrode-to-electrode distance), the insulation resistance between the discharge electrode and the induction electrode is made uniform, and the state of discharge is stabilized, with the result that it is possible to generate ions as desired. When the dielectric member 33 is formed in the shape of a cylinder, the first discharge electrode 31A and the second discharge electrode 32A are provided on the outer circumferential surface of the cylinder, and the first induction electrode 31B and the second induction electrode 32B are formed in the shape of a shaft, and thus it is possible to make constant the electrode-to-electrode distance. As the material of the first induction electrode 31B and the second induction electrode 32B, as with the first discharge electrode 31A and the second discharge electrode 32A, a material, such as tungsten, that has conductivity can be used without any particular restriction as long as it does not undergo deformation such as melting by discharge.

The discharge electrode contact point 31C is electrically continuous to the first discharge electrode 31A through the connection terminal 31E provided on the same formation surface (that is, the surface of the upper dielectric member 33A) as the first discharge electrode 31A and the connection path 31G. Hence, preferably, one end of a lead wire (such as a copper wire or an aluminum wire) is connected to the discharge electrode contact point 31C, and the other end of the lead wire is connected to the anode of the rectifier diode 21 (see FIG. 3).

The discharge electrode contact point 32C is electrically continuous to the second discharge electrode 32A through the connection terminal 32E provided on the same formation surface (that is, the surface of the upper dielectric member 33A) as the second discharge electrode 32A and the connection path 32G. Hence, preferably, one end of a lead wire (such as a copper wire or an aluminum wire) is connected to the discharge electrode contact point 32C, and the other end of the lead wire is connected to the cathode of the rectifier diode 22 (see FIG. 3).

The induction electrode contact point 31D is electrically continuous to the first induction electrode 31B through the connection terminal 31F provided on the same formation surface (that is, the surface of the lower dielectric member 33B) as the first induction electrode 31B and the connection path 31H. Hence, preferably, one end of a lead wire (such as a copper wire or an aluminum wire) is connected to the induction electrode contact point 31D and the other end of the lead wire is connected to the ground.

The induction electrode contact point 32D is electrically continuous to the second induction electrode 32B through the connection terminal 32F provided on the same formation surface (that is, the surface of the lower dielectric member 33B) as the second induction electrode 32B and the connection path 32H. Hence, preferably, one end of a lead wire (such as a copper wire or an aluminum wire) is connected to the induction electrode contact point 32D and the other end of the lead wire is connected to the ground.

In the ion generation element shown in FIGS. 4A and 4B and according to the first structure example, the first discharge electrode 31A and the second discharge electrode 32A have an acute-angled portion, electric field is concentrated at that portion and thus discharge is locally produced. By the discharge, $H^+(H_2O)_m$ (m is a natural number) that is a positive ion is generated at the second discharge portion, and $O_2^-(H_2O)_n$ (n is a natural number) that is a negative ion is generated at the first discharge portion.

Figure 4C:
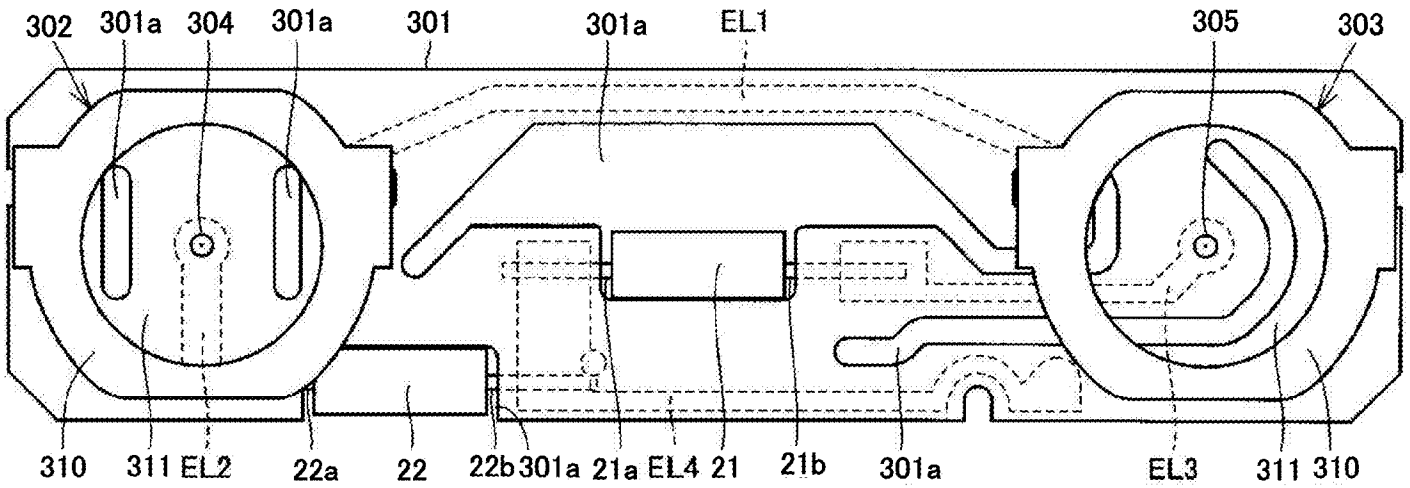
FIG. 4C A plan view of an ion generation element according to a second structure example including the first discharge portion and the second discharge portion.
Figure 4D:
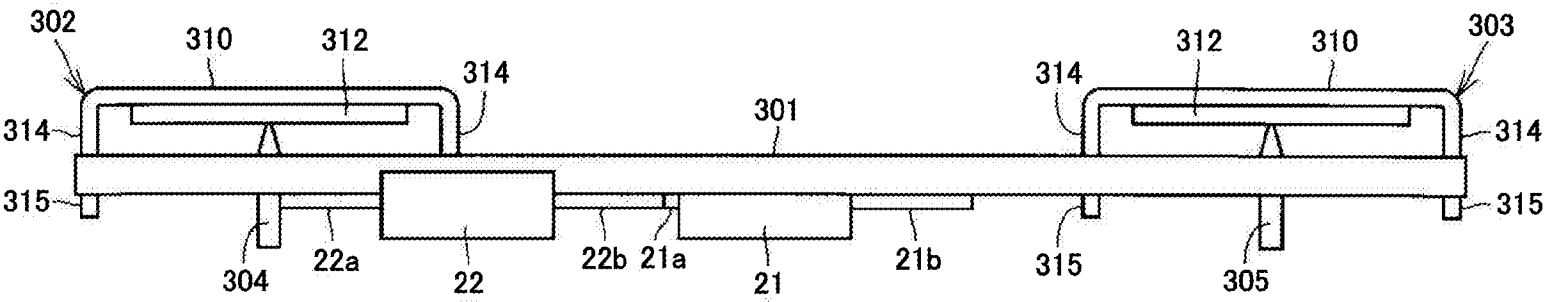
FIG. 4D A front view showing the second structure example of the ion generation element according to the second structure example including the first discharge portion and the second discharge portion.

Then, an ion generation element according to a second structure example including the first discharge portion and the second discharge portion will be shown in FIGS. 4C and 4D. FIG. 4C is a plan view of the ion generation element according to the second structure example; FIG. 4D is a front view of the ion generation element according to the second structure example. The ion generation element shown in FIGS. 4C and 4D and according to the second structure example includes a substrate 301, induction electrodes 302 and 303 and needle electrodes 304 and 305, and further incorporates, therewithin, the diodes 21 and 22 (see FIG. 3) of the high voltage circuit 2.

The substrate 301 is a rectangular printed substrate. The induction electrodes 302 and 303 each are formed as individual components; the induction electrode 302 is mounted at one end portion (the end portion on the left side of the figure) on the surface of the substrate 301, and the induction electrode 303 is mounted at the other end portion (the end portion on the right side of the figure) on the surface of the substrate 301.

Figure 4E:
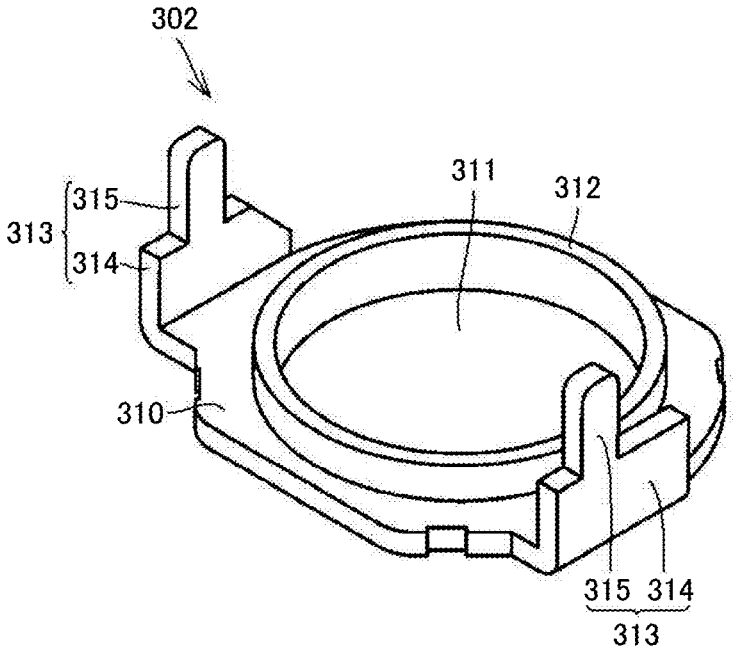
FIG. 4E A perspective view when an induction electrode included in the ion generation element according to the second structure example is seen from its lower side.

FIG. 4E is a perspective view when the induction electrode 302 is seen from its lower side. In FIG. 4E, the induction electrode 302 is formed with an integral metal plate. In the center of the flat plate portion 310 of the induction electrode 302, a circular through-hole 311 is formed. The diameter of the through-hole 311 is, for example, 9 mm. The through-hole 311 is an opening portion for discharging ions generated by corona discharge to the outside. The circumferential portion of the through-hole 311 is a bent portion 312 that is obtained by bending the metal plate with respect to the flat plate portion 310 by a method such as drawing processing. The bent portion 312 causes the thickness (for example, 1.6 mm) of the circumferential portion of the through-hole 311 to be greater than the thickness (for example, 0.6 mm) of the flat plate portion 310.

At each of both ends of the flat plate portion 310, a leg portion 313 is provided that is obtained by bending part of the metal plate with respect to the flat plate portion 310. Each of the leg portions 313 includes a support portion 314 on the substrate side and a substrate insertion portion 315 on the top end side. The height (for example, 2.6 mm) of the support portion 314 when it is seen from the surface of the flat plate portion 310 is greater than the thickness (for example, 1.6 mm) of the circumferential portion of the through-hole 311. The width (for example, 1.2 mm) of the substrate insertion portion 315 is less than the width (for example, 4.5 mm) of the support portion 314.

Then, with reference back to FIGS. 4C and 4D, the ion generation element according to the second structure example will be described. The two substrate insertion portions 315 of the induction electrode 302 are inserted into two through-holes (not shown) formed at one end portion of the substrate 301. The two through-holes are aligned in the direction of the length of the substrate 301. The top end portion of each of the substrate insertion portions 315 is soldered to the electrode on the back surface of the substrate 301. The lower end surface of the support portion 314 is in contact with the surface of the substrate 1. Hence, the flat plate portion 310 is arranged a predetermined space apart parallel to the surface of the substrate 301.

The induction electrode 303 has the same configuration as the induction electrode 302. The two substrate insertion portions 315 of the induction electrode 303 are inserted into the two through-holes (not shown) formed at the other end portion of the substrate 301. The two through-holes are aligned in the direction of the length of the substrate 301. The top end portion of each of the substrate insertion portions 315 is soldered to the electrode on the back surface of the substrate 301. The lower end surface of the support portion 314 is in contact with the surface of the substrate 301. Hence, the flat plate portion 310 is arranged a predetermined space apart parallel to the surface of the substrate 301.

The total of four substrate insertion portions 315 of the induction electrodes 302 and 303 are aligned in the direction of the length of the substrate 301. The two substrate insertion portions 315 on the side of the center of the substrate 301 are electrically connected to each other by an electrode EL1 on the back surface of the substrate 301.

As shown in FIGS. 4C and 4D, the induction electrodes 302 and 303 need to be prevented from extending from the outline of the substrate 301 after being attached, and the dimensions of the induction electrodes 302 and 303 are equal to or less than the width of the substrate 301 and are limited to half or less of the length of the substrate 301. The vertical and horizontal dimensions of the induction electrodes 302 and 303 are substantially equal to each other so that the shapes of the components are minimized to achieve a lower cost and enhancement of the productivity.

In the substrate 301, a through-hole (not shown) is formed through which the center line of the through-hole 311 of the induction electrode 302 is passed, and the needle electrode 304 is inserted into the above through-hole. The needle electrode 304 is provided to generate the positive ions. The top end of the needle electrode 304 protrudes from the surface of the substrate 301, its base end protrudes from the back surface of the substrate 301 and its center portion is soldered to an electrode EL2 formed on the back surface of the substrate 301. The height of the top end of the needle electrode 304 when seen from the surface of the substrate 301 is set within a range between the height of the lower end of and the height of the upper end of the bent portion 312 of the induction electrode 302 (for example, an intermediate height between the lower end and the upper end).

Moreover, in the substrate 301, a through-hole (not shown) is formed through which the center line of the through-hole 311 of the induction electrode 303 is passed, and the needle electrode 305 is inserted into the above through-hole. The needle electrode 305 is provided to generate the negative ions. The top end of the needle electrode 305 protrudes from the surface of the substrate 301, its base end protrudes from the back surface of the substrate 301 and its center portion is soldered to an electrode EL3 formed on the back surface of the substrate 301. The height of the top end of the needle electrode 305 when seen from the surface of the substrate 301 is set within a range between the height of the lower end of and the height of the upper end of the bent portion 312 of the induction electrode 303 (for example, an intermediate height between the lower end and the upper end). The distance between the top ends of the needle electrodes 304 and 305 is set at a predetermined value.

The cathode terminal line 22*a* of the diode 22 is soldered to the electrode EL2, and is electrically connected to the needle electrode 304. The anode terminal line 22*b* of the diode 22 is soldered to an electrode EL4 on the back surface of the substrate 301. The cathode terminal line 21*a* of the diode 21 is soldered to the electrode EL4, and is electrically connected to the anode terminal line 22*b* of the diode 22. The anode terminal line 21*b* of the diode 21 is soldered to the electrode EL3, and is electrically connected to the needle electrode 305.

In the substrate 301, notches 301*a* for insertion of the main body portions of the diodes 21 and 22 and for separation of the electrodes EL2 to EL4 on the high voltage side from the electrode EL1 on the reference voltage side are funned in a plurality of places. The notches 301*a* are filled with mold resin.

In the ion generation element shown in FIGS. 4C and 4D and according to the second structure example, electric field is concentrated at the top end portion of each of the needle electrodes 304 and 305 and thus discharge is locally produced. By the discharge, $H^+(H_2O)_m$ (m is a natural number) that is a positive ion is generated at the needle electrode 304, and $O_2^-(H_2O)_n$ (n is a natural number) that is a negative ion is generated at the needle electrode 305.

The pulse signal P1 generated by the microcontroller 15 will now be described.

The basic operation of the high voltage transformer 13 includes the forward operation of outputting a high voltage to the secondary side while current is being passed to the primary side and the fly-back operation of outputting a high voltage to the secondary side when the current on the primary side is stopped.

In a conventional ion generation device, a high voltage is generated by a high voltage transformer with either of the forward operation and the fly-back operation. On the other hand, in the ion generation device of the present invention, a high voltage is generated by the high voltage transformer with both of the forward operation and the fly-back operation, and thus the consumption current is significantly reduced. In the present embodiment, in order for a high voltage to be generated by the high voltage transformer 13 with both of the forward operation and the fly-back operation, the pulse width of an on-period of the pulse signal P1 is adjusted such that the pulse width of the on-period during which the switching element 14 is kept on by the pulse signal P1 is substantially equal to a time obtained by multiplying the reciprocal of an output voltage frequency at the time of the forward operation of the high voltage transformer 13 by one-fourth. The pulse width of the on-period of the pulse signal P1 adjusted by the microcontroller 15 can be preferably changed so that it is possible to correspond to high voltage transformers of various specifications.

Figure 5:
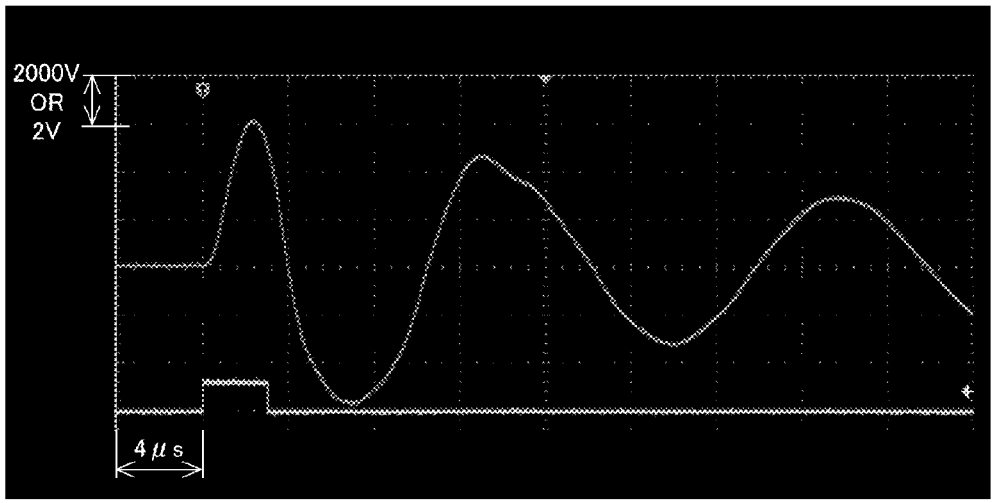
FIG. 5 A time chart showing the measurements of a pulse signal and an output voltage of a high voltage transformer according to the embodiment of the present invention.
Figure 5:
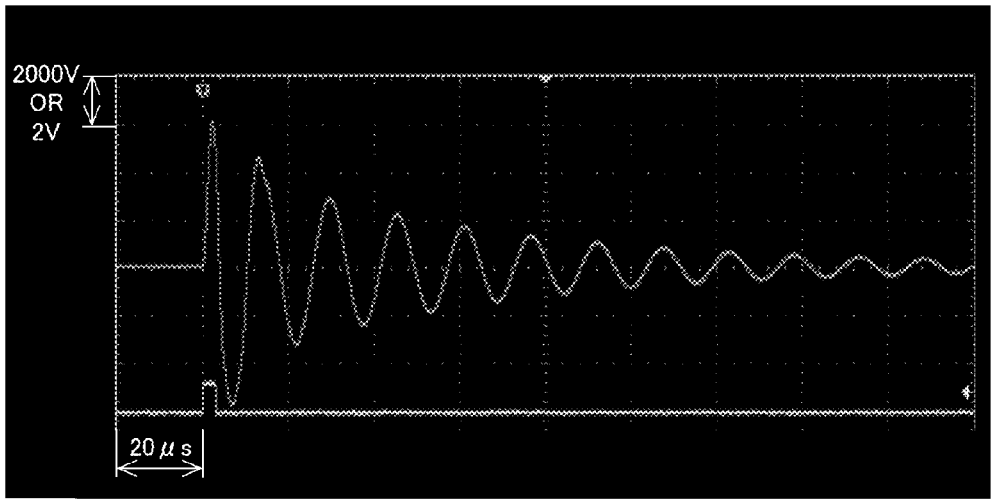

The measurement results of the pulse width of the on-period of the pulse signal P1 and a high voltage output from the secondary side of the high voltage transformer 13 when a high voltage transformer in which the reciprocal of an output voltage frequency at the time of the forward operation is about 12000 ns is used as the high voltage transformer 13 will be shown in FIG. 5. In the present embodiment, the pulse width of the on-period of the pulse signal P1 is 3000 ns that is substantially equal to a time obtained by multiplying the reciprocal of the output voltage frequency at the time of the forward operation of the high voltage transformer 13 by one-fourth.

Figure 6:
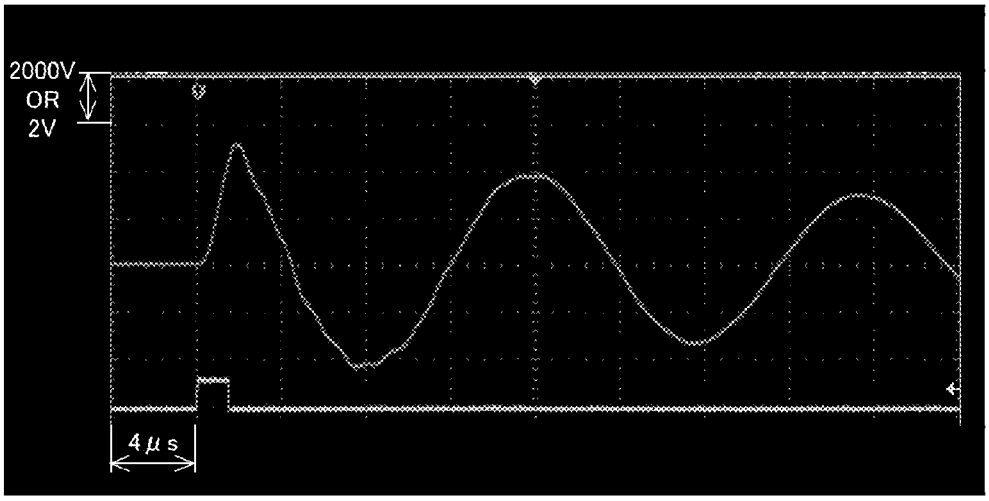
FIG. 6 A time chart showing the measurements of a pulse signal and an output voltage of a high voltage transformer in a comparative example.
Figure 6:
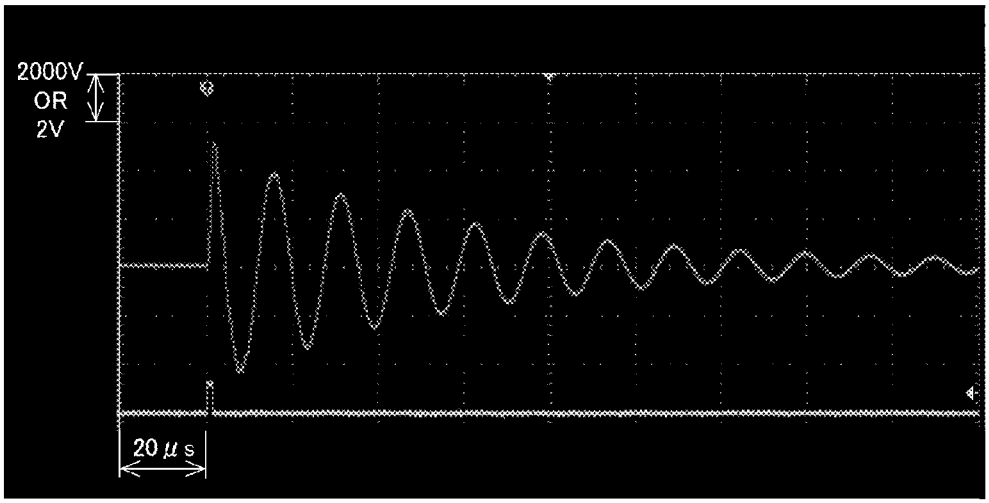
Figure 7:
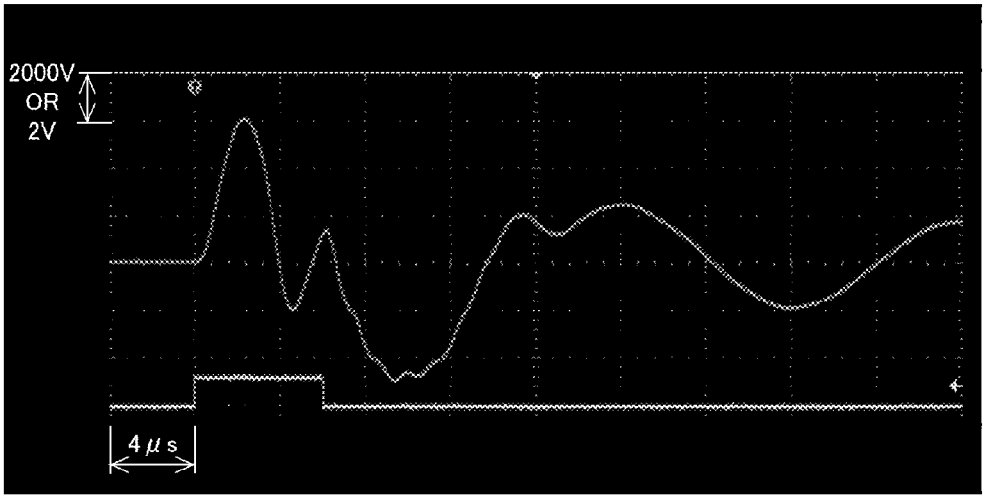
FIG. 7 A time chart showing the measurements of a pulse signal and an output voltage of a high voltage transformer in a comparative example.
Figure 7:
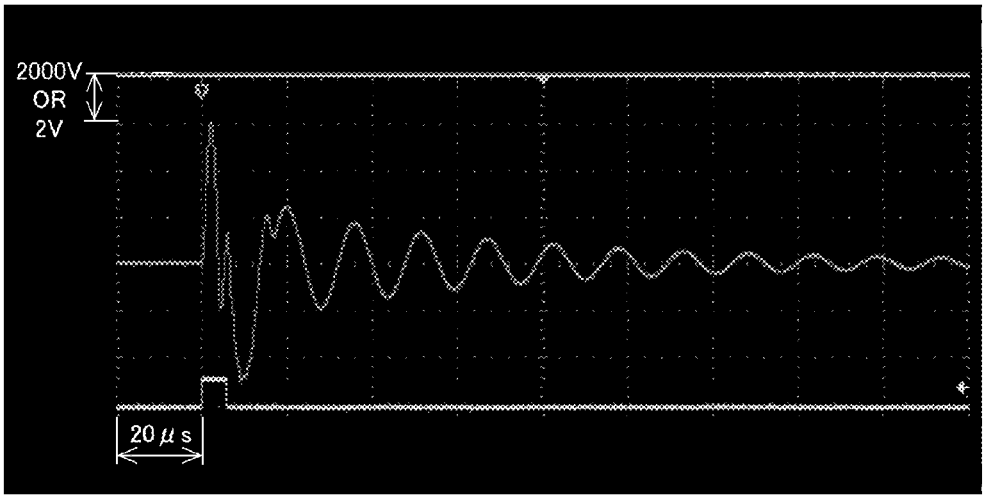

On the other hand, as comparative examples, measurement results when the pulse width of the on-period of the pulse signal P1 is set at 1500 ns (a time shorter than in the present embodiment) that is substantially equal to a time obtained by multiplying the reciprocal of the output voltage frequency at the time of the forward operation of the high voltage transformer 13 by one-eighth will be shown in FIG. 6; and measurement results when the pulse width of the on-period of the pulse signal P1 is set at 6000 ns (a time longer than in the present embodiment) that is substantially equal to a time obtained by multiplying the reciprocal of the output voltage frequency at the time of the forward operation of the high voltage transformer 13 by one-half will be shown in FIG. 7.

In FIGS. 5 to 7, the voltage range of the pulse signal P1 is 2 V/Div, and the voltage range of the high voltage output from the secondary side of the high voltage transformer 13 is 2000 V/Div. In FIGS. 5 to 7, FIGS. 5(*a*) to 7(*a*) differ from FIGS. 5(*b*) to 7(*b*) in that the time range is only changed; in FIGS. 5(*a*) to 7(*a*), the time range is 4 μs/Div, and in FIGS. 5(*b*) to 7(*b*), the time range is 20 μs/Div.

In the present embodiment, the high voltage output from the secondary side of the high voltage transformer 13 is approximately sinusoidal (see FIG. 5), and the voltage is stepped up highly efficiently with little loss. On the other hand, in the comparative examples, an acute-angled portion and ringing are present in the high voltage output from the secondary side of the high voltage transformer 13, and thus its waveform is disturbed (see FIGS. 6 and 7), with the result that it is found that a large number of losses are produced.

Here, the relationship between the pulse width of the on-period of the pulse signal P1, the high voltage output from the secondary side of the high voltage transformer 13, the consumption current of the ion generation device and an output voltage per unit consumption current (1 mA) will be shown on Table 1. In the present embodiment, the high voltage output from the secondary side of the high voltage transformer 13 is 11920 V (peak-to-peak value), in comparative example 1, the high voltage output from the secondary side of the high voltage transformer 13 is 9600 V (peak-to-peak value) and in comparative example 2, the high voltage output from the secondary side of the high voltage transformer 13 is 11200 V (peak-to-peak value), with the result that it is found that in the present embodiment, the maximum voltage is output. Moreover, with respect to the output voltage per unit consumption current, which is an index indicating the efficiency of the stepping up of the voltage, in the present embodiment, the maximum value of 2820 V/mA is shown, with the result that it is found that the high voltage transformer 13 is operated the most efficiently.

TABLE 1

| | Pulse width of on-period of pulse signal P1 (ns) | Peak-to-peak output voltage of high voltage transformer 13 (V) | Consumption current (mA) | Output voltage per unit consumption current (V/mA) |
|---|---|---|---|---|
| Present example | 3000 | 11920 | 4.23 | 2820 |
| Comparative example 1 | 1500 | 9600 | 4.06 | 2360 |
| Comparative example 2 | 6000 | 11200 | 12.92 | 870 |

The reason why in the present embodiment, the high voltage transformer 13 is stepped up efficiently as discussed above will be described with reference to FIG. 5.

The pulse signal P1 is switched from the off-period to the on-period, the switching element 14 is switched from the off-state to the on-state and thus current is passed to the primary side of the high voltage transformer 13. By this current, the high voltage is excited on the secondary side of the high voltage transformer 13, and the output voltage is raised. When the output voltage on the secondary side of the high voltage transformer 13 is close to the peak voltage, the pulse signal P1 is switched from the on-period to the off-period, and thus the current on the primary side of the high voltage transformer 13 is interrupted. Here, the on-period of the pulse signal P1 is substantially equal to the time obtained by multiplying the reciprocal of the output voltage frequency at the time of the forward operation of the high voltage transformer 13 by one-fourth. In the on-period of the pulse signal P1, the high voltage transformer 13 performs the forward operation.

In the period of the forward operation during which the current is passed to the primary side of the high voltage transformer 13, at the same time when a high voltage waveform is output to the secondary side, magnetic energy is stored in the magnetic core of the high voltage transformer 13. When the current on the primary side of the high voltage transformer 13 is interrupted, the high voltage transformer 13 performs the fly-back operation of converting the magnetic energy stored in the magnetic core of the high voltage transformer 13 into electrical energy to output the high voltage to the secondary side.

As described above, the on-period of the pulse signal P1 is made substantially equal to the time obtained by multiplying the reciprocal of the output voltage frequency at the time of the forward operation of the high voltage transformer 13 by one-fourth, and thus it is possible to continuously utilize the forward operation and the fly-back operation of the high voltage transformer 13, with the result that it is possible to efficiently step up the voltage. In this way, it is possible to obtain a high voltage with a small amount of consumption current, with the result that it is possible to reduce the power consumption. Thus, the ion generation device that is conventionally incorporated in only an electrical apparatus to which power is input from a commercial power supply can be used as a portable ion generation device that can be operated by a battery or the like.

Although patent document 3 discloses that the on-period of the pulse signal is made longer, and thus the output voltage of the stepping-up portion is increased, as shown in FIG. 7, when the on-period of the pulse signal is excessively long, the output voltage is decreased, and simultaneously, the consumption current is increased. Although patent document 4 discloses that the output voltage of a width corresponding to the on-period of the pulse signal is output, as shown in FIG. 7, the frequency of the output voltage of the high voltage transformer 13 is constant regardless of the on-period of the pulse signal.

Figure 8:
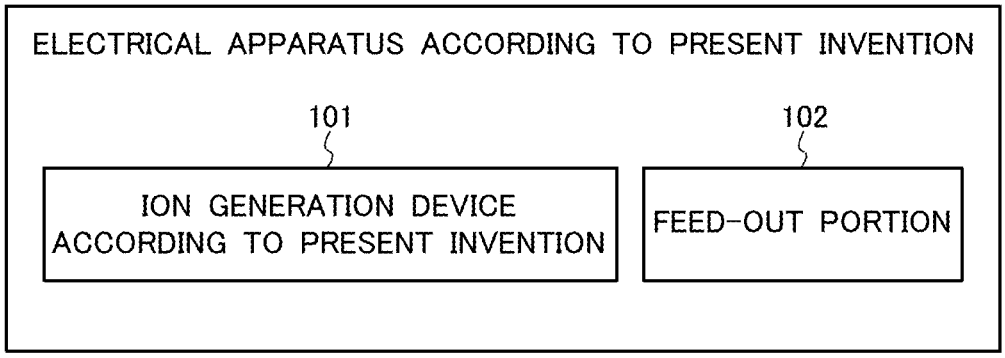
FIG. 8 A diagram showing a schematic configuration of an electrical apparatus according to the present invention.

The ion generation device of the present invention described above can be incorporated in an electrical apparatus. In the electrical apparatus incorporating the ion generation device of the present invention, as shown in FIG. 8, not only the ion generation device 101 of the present invention but also a feed-out portion (for example, a blower fan) 102 that feeds the ions generated by the ion generation device 101 of the present invention out of the ion generation device 101 of the present invention is preferably incorporated. In the electrical apparatus described above, it is possible not only to achieve the original function of the apparatus but also to inactivate mold and bacteria in the air to reduce their growth by the action of the positive ions and the negative ions discharged from the ion generation device incorporated, with the result that it is possible to bring an indoor environment into the state of a desired atmosphere.

The ion generation device of the present invention is not limited to an ion generation device that generates the positive ions and the negative ions in substantially equal amounts; for example, an ion generation device may generate only the positive ions by removing the rectifier diode 21 from the high voltage circuit 2 shown in FIG. 2 and removing the first discharge portion including the first discharge electrode 31A and the first induction electrode 31B from the ion generation element 3 shown in FIG. 2. An ion generation device may generate only the negative ions by removing the rectifier diode 22 from the high voltage circuit 2 and removing the second discharge portion including the second discharge electrode 32A and the second induction electrode 32B from the ion generation element 3 shown in FIG. 2.

INDUSTRIAL APPLICABILITY

The ion generation device of the present invention can be incorporated in, for example, an air conditioner, a dehumidifier, a humidifier, an air cleaner, a refrigerator, a fan heater, a microwave oven, a washer-dryer, a vacuum cleaner and a sterilizer.

LIST OF REFERENCE SYMBOLS

1 high voltage generation circuit
2 high voltage circuit
3 ion generation element
11 DC/DC converter
12 capacitor
13 high voltage transformer
14 switching element
15 microcontroller
16 buffer circuit
21, 22 rectifier diode
21*a*, 22*a* cathode terminal line
21*b*, 22*b* anode terminal line
31 A first discharge electrode
31B first induction electrode
31C, 32C discharge electrode contact point
31D, 32D induction electrode contact point
31E, 31F, 32E, 32F connection terminal
31G, 31H, 32G, 32H connection path
32A second discharge electrode
32B second induction electrode
33 dielectric member
33A upper dielectric member
33B lower dielectric member
34 coating layer
101 ion generation device of the present invention
102 feed-out portion
301 substrate
301*a* notch
302, 303 induction electrode
304, 305 needle electrode
310 flat plate portion
311 through-hole
312 bent portion
313 leg portion
314 support portion
315 substrate insertion portion
EL1 to EL4 electrode

The invention claimed is:

1. An ion generation device comprising:

a high voltage generation circuit; and an ion generation element to which a high voltage output from the high voltage generation circuit or a voltage generated based on the high voltage output from the high voltage generation circuit is applied, wherein the high voltage generation circuit includes:

a capacitor which stores an input direct-current voltage or a voltage obtained by performing DC/DC conversion on the input direct-current voltage;

a high voltage transformer which steps up a voltage output from the capacitor connected to a primary side to output a high voltage to a secondary side;

a switching element which is connected to the primary side of the high voltage transformer and which intermittently passes a current on the primary side of the high voltage transformer by being turned on and off; and a pulse signal generation portion which generates a pulse signal for controlling the turning on and off of the switching element, and the pulse signal generation portion adjusts a pulse width of an on-period such that the pulse width of the on-period during which the switching element is kept on by the pulse signal is substantially equal to a time obtained by multiplying a reciprocal of an output voltage frequency at a time of a forward operation of the high voltage transformer by one-fourth.

2. The ion generation device of claim 1, wherein the pulse width of the on-period adjusted by the pulse signal generation portion can be changed.

3. The ion generation device of claim 1, wherein the switching element is directly driven by the pulse signal.

4. The ion generation device of claim 1, wherein the capacitor stores the input direct-current voltage.

5. The ion generation device of claim 1, wherein the capacitor is a ceramic capacitor or a film capacitor.

6. The ion generation device of claim 1, wherein the switching element is a MOS-FET.

7. The ion generation device of claim 1, wherein the switching element is a bipolar transistor.

8. The ion generation device of claim 1, wherein the switching element is an IGBT.

9. The ion generation device of claim 1, wherein the pulse signal generation portion is a microcontroller which controls the generation of the pulse signal with software.

10. The ion generation device of claim 1, wherein the pulse signal generation portion is a dedicated circuit which controls the generation of the pulse signal with hardware.

11. An electrical apparatus comprising:

the ion generation device of claim 1; and a feed-out portion for feeding ions generated by the ion generation device out of the ion generation device.

* * * * *